United States Patent [19]

Cleary, Jr.

[11] Patent Number: 4,648,550

[45] Date of Patent: Mar. 10, 1987

[54] TAMPERPROOF MAILBOX ASSEMBLY

[75] Inventor: Vincent J. Cleary, Jr., Bridgeport, Conn.

[73] Assignee: Cynthia A. Cleary, Bridgeport, Conn.

[21] Appl. No.: 770,407

[22] Filed: Aug. 28, 1985

[51] Int. Cl.[4] ..... B65D 91/00

[52] U.S. Cl. ..... 232/25; 232/43.4; 109/56

[58] Field of Search ..... 232/4 R, 24, 25, 43.4; 312/199, 211; 109/53, 56

[56] References Cited

U.S. PATENT DOCUMENTS

| | | | |
|---|---|---|---|
| 2,781,965 | 2/1957 | Dembs | 232/43.4 |
| 3,784,089 | 1/1974 | Koch | 232/25 X |
| 4,073,554 | 2/1978 | Oder et al. | 109/53 X |
| 4,557,416 | 12/1985 | Stahl et al. | 232/43.4 X |

FOREIGN PATENT DOCUMENTS

| | | | |
|---|---|---|---|
| 564163 | 9/1958 | Canada | 232/24 |

*Primary Examiner*—Robert P. Swiatek
*Attorney, Agent, or Firm*—Allen D. Brufsky

[57] ABSTRACT

A multi-family mailbox assembly wherein each individual box is disposed in a modular frame. Each module can be secured in side to side relationship to another to give the appearance of a horizontal and vertical rectangular array of boxes. Each box is inserted into and recessed backward from the front edge of each modular frame to preclude and prevent any efforts to pry open one of the doors of the box, as by the insertion of a screwdriver, crowbar, or other sharp-pointed tool between the door and module frame.

9 Claims, 14 Drawing Figures

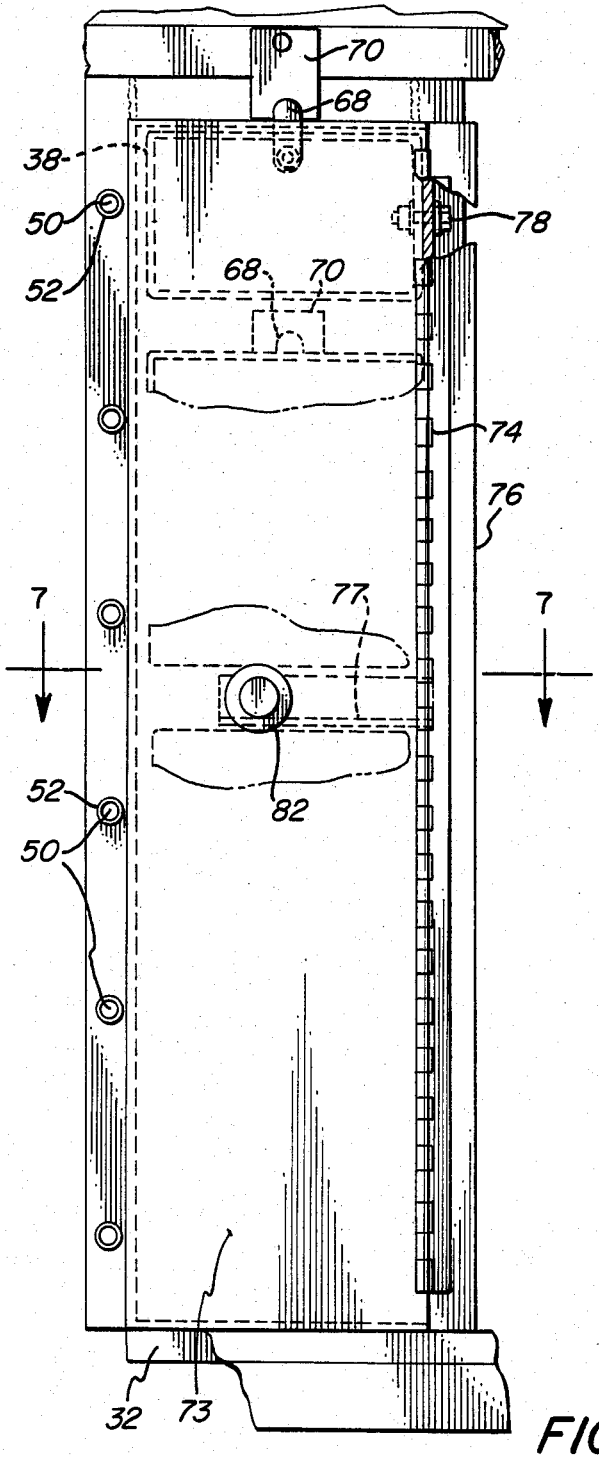
FIG. 6
FIG. 7
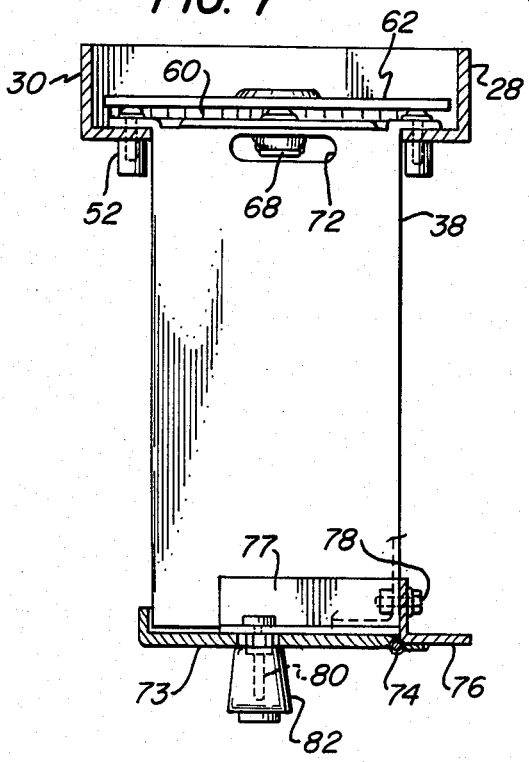
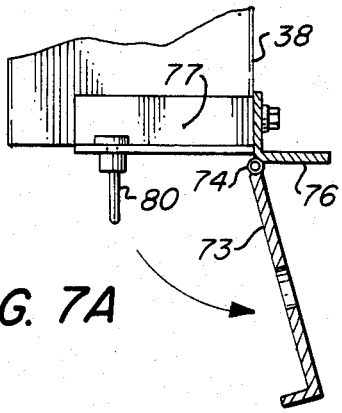
FIG. 7A

FIG. 8
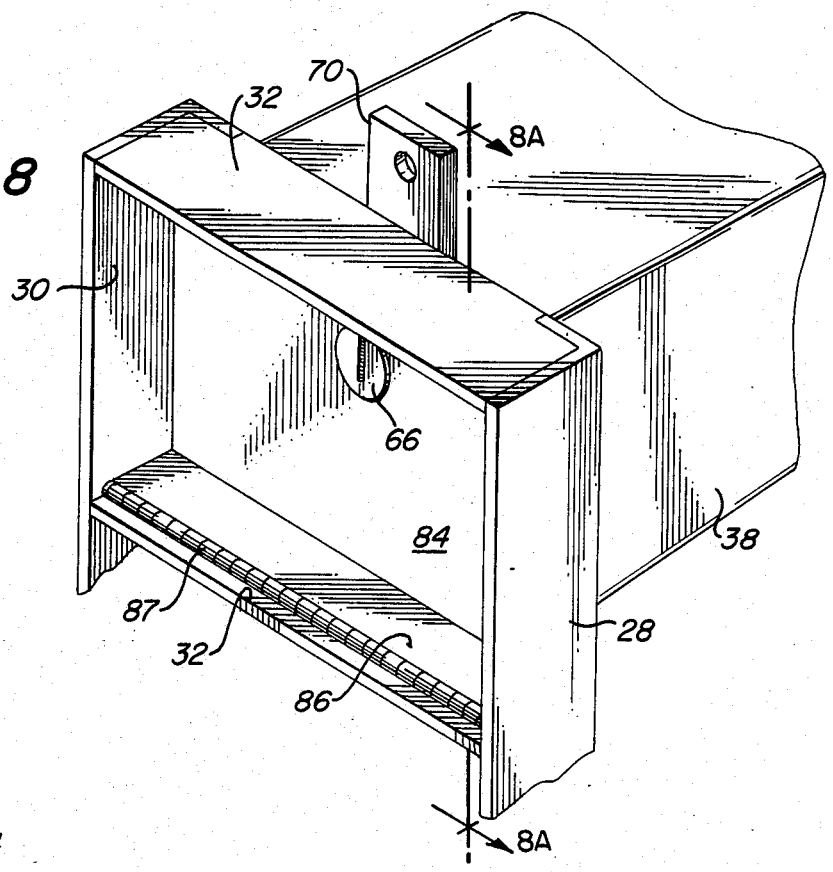
FIG. 8A
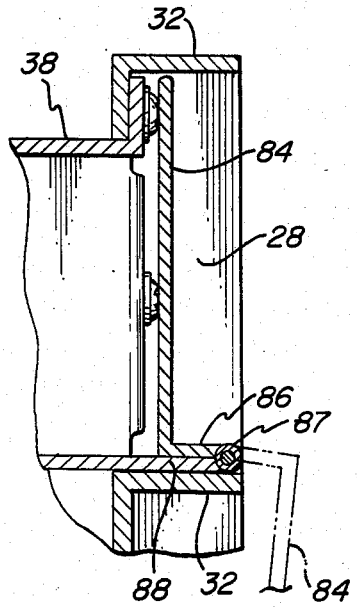
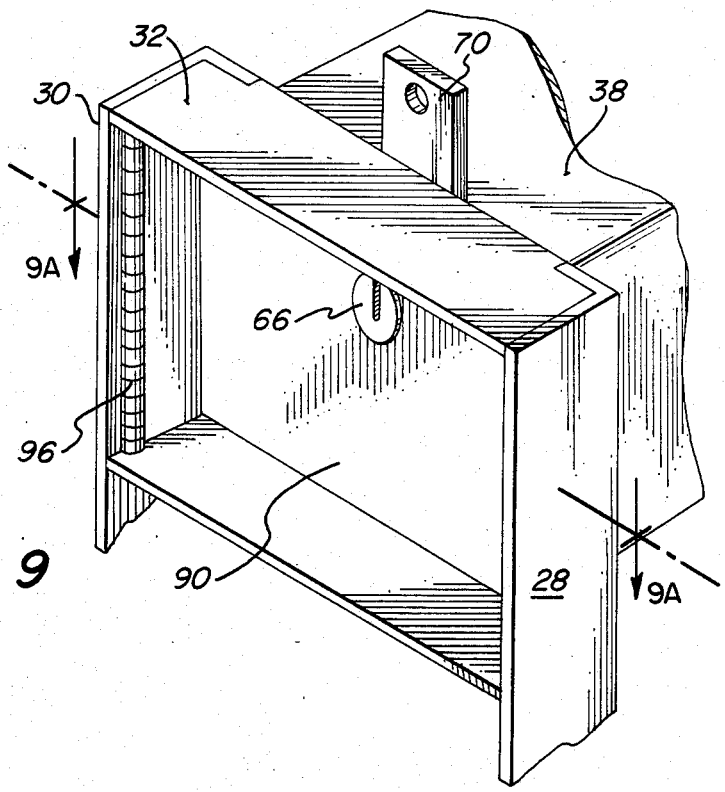
FIG. 9

FIG. 9A
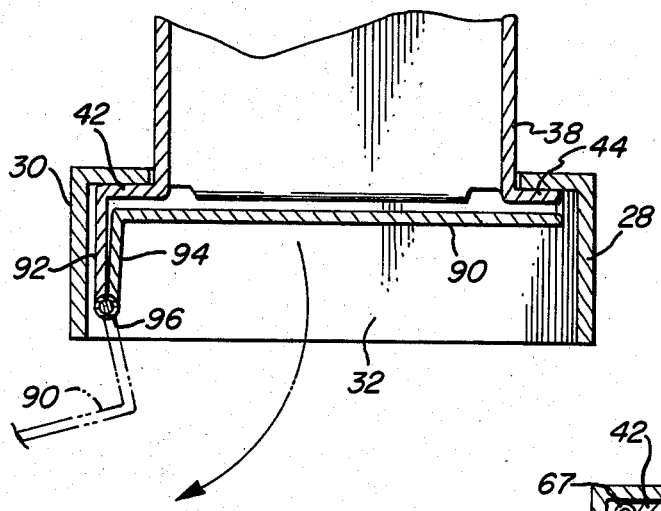
FIG. 10
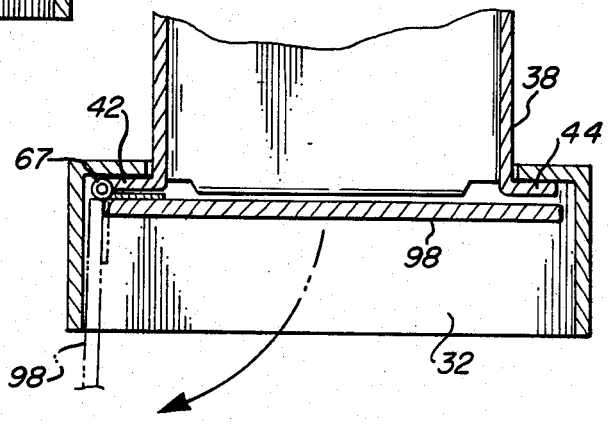
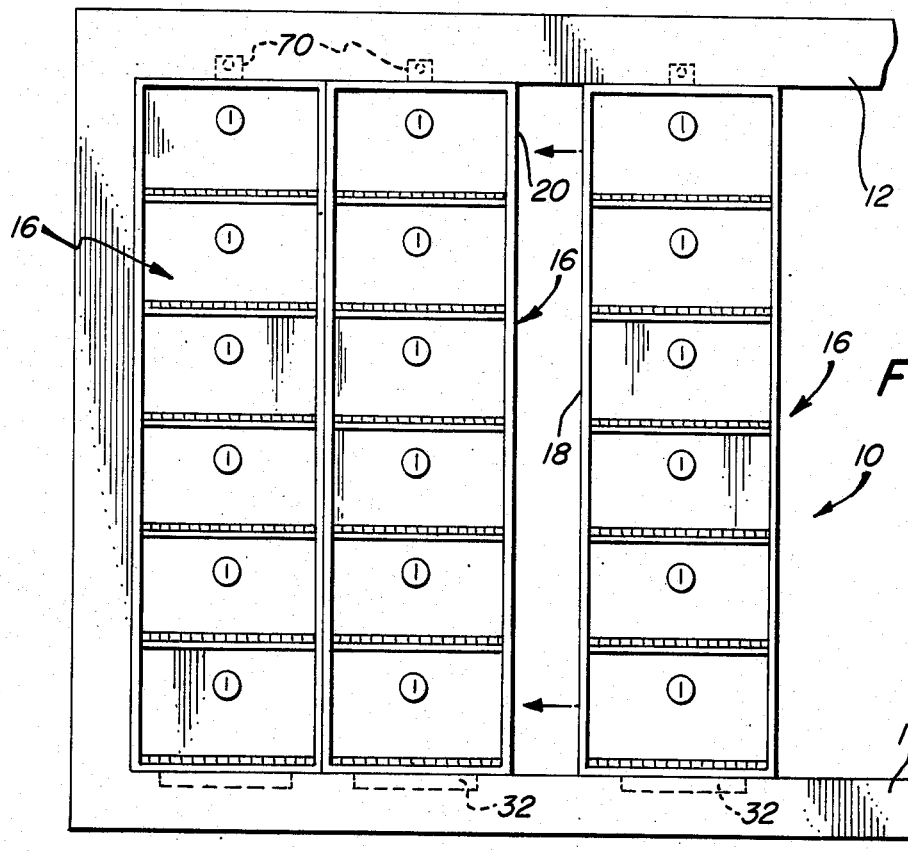
FIG. 11

TAMPERPROOF MAILBOX ASSEMBLY

BACKGROUND OF THE INVENTION

1. Field Of The Invention

This invention relates to a mailbox assembly, and more particularly, a mailbox assembly suitable for a multi-family dwelling which substantially reduces the risk of theft of the contents housed within any one or more of the mailboxes of the assembly.

2. Description Of The Prior Art

Typically, individual mailboxes are installed in multi-family dwellings, such as apartment houses, in a vertical and horizontal array, within a frame. The front cover of each individual box is usually substantially flush with the frame and contains a lock so that each cover can be opened by an individual. A particular bank of covers are also locked together so they can be opened as a unit by a postman so that each individual box can be filled from the exterior or coverside of the box. Alternatively, access to the rear of the individual boxes can be had by providing a cover or door on the interior side of the frame of the horizontal and vertical array which can opened by an authorized government employee, such as a mail carrier.

Unauthorized opening of individual mailboxes is a common occurrence in multi-family dwellings; particularly, where security is at a minimum. Older tenants are often easy marks for theft of monthly social security checks which are received through the mail on subtantially the same day. It is simple to pry open the cover of each individual box of the typical multi-family mail box array by simply inserting an instrument having a sharp end, such as a screw driver or lever between the cover and frame or between a pair of adjacent covers and pry open, by swiveling or pivoting the cover to an open position, to expose the contents of the box. Further, once one of the covers is pried open and bent, in order to replace it, it is often necessary to replace the entire array of boxes, particularly where they are the type wherein access is obtained by a mail carrier from the exterior by opening all the covers at the same time.

Accordingly, this invention relates to a mailbox assembly for a multi-family dwelling which is virtually tamperproof precluding unauthorized entry, but, if entry is attained or if the box becomes damaged and must be replaced, only one modular unit consisting of a given number of mailboxes need be replaced and not the entire assembly or array.

SUMMARY OF THE INVENTION

In accordance with the present invention, a multi-family mailbox assembly is formed wherein each individual box is disposed in a modular frame. Each module can be secured in side to side relationship to another in a frame to give the appearance of a horizontal and vertical rectangular array of boxes. Each box is inserted into and recessed backward from the front edge of each modular frame to preclude and prevent any efforts to pry open one of the doors of the box, as by the insertion of a screwdriver, crowbar, or other sharp-pointed tool between the door and module frame. If the frame is tampered with or one of the boxes is destroyed, it is only necessary to replace one of the frame modules, rather than the entire array of horizontal and vertical boxes or the outer framework for receiving the same.

When the doors of each box are locked and housed in recessed relationship with respect to the front of the frame, all access to screw fasteners mounting each box to the frame is also covered, thereby minimizing the possibility of unauthorized personnel attempting to remove the screws. Each screw itself mounting a box to a module frame can be of the tamper-proof type requiring a special tool to effect turning of he screw and therefore removal of the box mounted on the module framework of the entire assembly.

The door of each mailbox can be hinged either to the sidewall or the bottom wall of each individual box attached to the modular framework in order to comply with postal regulations so that any locking mechanism will be out of the path of any parcel or piece of mail which must be removed from the box when the cover is opened.

BRIEF DESCRIPTION OF THE DRAWINGS

Further objects and advantages of the invention will become more apparent from the following description and claims, and from the accompanying drawings, wherein:

FIG. 6 is a rear view in elevation of the module frame of FIG. 3;

FIG. 7 is a cross-sectional view taken substantially along the plane indicated by line 7—7 of FIG. 6;

FIG. 7A is a view similar to the bottom portion of FIG. 7 but with a rear door closing a series of boxes on each module frame opened providing access thereto;

FIG. 8 is a partial perspective view of the front of a module frame of the present invention provided with a series of mailboxes having an alternative form of door providing access to the contents of each box;

FIG. 8A is a cross-sectional view taken substantially along the plane indicated by line 8A—8A of FIG. 8, and further showing in phantom lines the manner in which the door opens to provide access to the interior of an individual mailbox in the module;

FIG. 9 is a view similar to FIG. 8 but illustrating the mounting of a mailbox on the module frame of FIG. 1 having a still further embodiment of a door;

FIG. 9A is a cross-sectional view taken substantially along the plane indicated by line 9A—9A of FIG. 9, and further illustrating in phantom lines the manner in which the door can be opened to expose the interior of one of the boxes of the module frame;

FIG. 10 is a cross-sectional view similar to FIG. 9A but illustrating a mailbox having a still further embodiment of a door; and FIG. 11 is a front view in elevation of a plurality of the module frames of FIG. 1 assembed so as to present a vertical and horizontal array of mailboxes which are recessed within an outer framework support in a multi-family dwelling.

DETAILED DESCRIPTION OF THE PREFERRED EMBODIMENT

Figure 1:
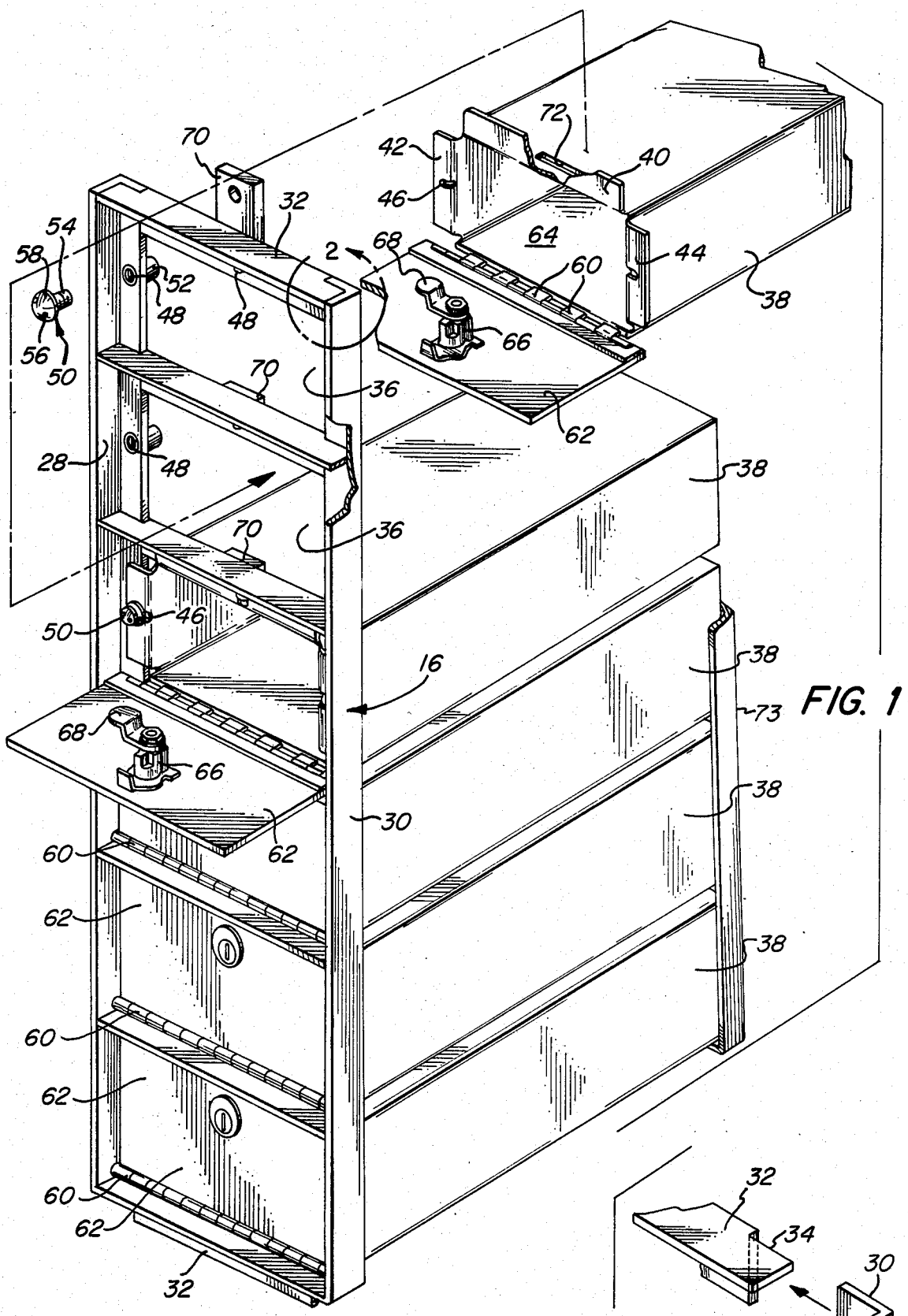
FIG. 1 is an exploded perspective view of a module frame of the present invention mounting a plurality of mailboxes; each module being adapted to be placed in side-by-side relation to form the improved tamperproof mailbox assembly of the present invention.

Referring now to the drawings in detail, wherein like numerals indicate like elements throughout the several views, an array of mailboxes 10 are adapted to be disposed between pair of parallel, supporting wood frame members 12, 14 (see FIG. 11). The mailbox assembly 10 consists of a plurality of module frames 16 whose side frame members 18, 20 are abutted to leave the perception of a plurality of individual horizontal and vertical boxes 38 supported between frame members 12, 14.

Each of the modules 16 is connected to one of the frame members 12, 14 as will be described in more detail hereinafter by threaded fasteners 26 (see FIG. 3). If one of the module frames 16 is damaged or any of the mailboxes 38 seated within a module frame 16 is damaged or tampered with, either the module frame or the individual box need be replaced and not the entire assembly or array 10. While each module frame 16 is disclosed as containing six mailboxes, it will be understood that any number, as desired, may be retained within one of the module frames 16.

Each of the module frames 16 is fabricated from angle iron stock preferably 3/16th of an inch thick whose legs are $1\frac{1}{4}$ inches$\times$2 inches. Each module is formed, as illustrated more clearly in FIGS. 1 and 2, from left and right parallel upright angle iron members 28 and 30, respectively. The same type of angle stock is welded horizontally across the members 28, 30 as indicated at 32. Each of the members 32 is on the order of 9 and 1/16 inches long and there is about $6\frac{1}{2}$ inch vertical spacing between each of the cross members 32.

Figure 2:
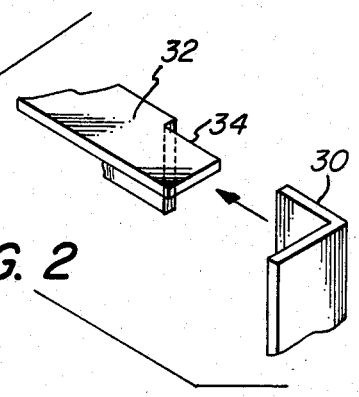
FIG. 2 is a partial, exploded perspective view of the upper right hand corner designated by the circle 2 of the module frame of FIG. 1, illustrating in greater detail the manner of assembling the module.

Each cross piece 32 is cut or notched, as indicated in FIG. 2 in the opposite corner areas 34 between the vertical and horizontal legs so that the cutout areas 34 will fit into the corners of the respective, adjacent upright member 28, 30 and can be welded or otherwise secured to each of the shorter, coplanar legs of the upright members 28, 30 at spaced locations therealong to form an opening 36 through an elongated metal receptacle or box 38 is slidably received.

The box 38 is fabricated so as to be open at opposite ends. For this purpose, box 38 is preferably constituted of 18 gauge sheet metal and fabricated as two pieces; one piece comprising two side panels and an integral top panel and the other piece comprising a bottom panel that this welded to the side panels to form a rectangular parallelepiped construction. The dimensions of each box are roughly $6\frac{1}{4}$ inches wide, 5 inches high and 15 inches deep.

Each box 38 is provided with an upwardly extending mounting flange 40 secured to the top panel of the box and opposed side mounting flanges 42, 44 extending laterally outwardly from each of the side walls of the box 38. Holes 46 are provided in each of the flanges 40, 42 and 44 to enable each compartment or box 38 to be secured to the shorter legs which face inwardly from each of the adjacent angle iron members 28, 30, and 32 by aligning the openings 46 in each of the flanges 40, 42, 44 with a complementary opening 48 and a tamperproof screw such as 50 is inserted therethrough which receives a nut 52 on a threaded shank 54. As shown the tamperproof screws or threaded fasteners 50 comprise spanner-type screws having a pair of spaced openings 56 in their heads 58 which receive a spanner-type wrench (not shown) in order to rotate the head 58 of threaded fastener 50. Use of the tamperproof threaded spanners or screws 50 discourages any attempt at disassembly of the boxes 38 from a module frame 16.

Welded to the lower or bottom wall of each of the compartments or boxes 38 is one part of a hinge 60. The other part of hinge 60 is welded to a door 62 which normally covers or spans the front opening 64 of each box 38. As indicated in FIGS. 1 and 3, the doors 62 can normally be swung downwardly about the hinges 60. The interior of door 62 is provided with a key-operated rotatable latch 68, adapted to be pivoted and received behind a latch plate 70 mounted on the back of each cross piece 32. Latch 68 is pivotable through an opening 72 provided in the top wall of box 38. Each of the latch plates 70 is disposed behind the downwardly extending leg of each of the cross pieces 32 except the lower most one in the module frame 16.

Because of the construction described, replacement of a particular compartment or box 38 and its door 62 is facilitated, since these components are connected by the hinge 60 and no welds are made to either the legs of the upright angle members 28, 30 or the cross pieces 32. Such replacement might be necessitated if one of the compartments of boxes 38 would be inadvertently damaged, for example, during an attempt to pry open the cover 62 on the compartment or box 38.

Further, due to the arrangement described, each of the doors 62, when closed, is completely recessed by an inch or so behind the front edges of each of the upright angle iron members 28, 30 and cross pieces 32 which bars access to the cracks between the doors on the one hand, and the upright members 28, 30 and cross pieces 32 on the other. As a consequence, any attempt or effort to pry open a locked door 62, as by insertion of a screwdriver, crowbar, or other sharpedged tool between the door and any of the upright angle iron members 28, 30 or cross pieces 32 will be prevented. Preferably, the door 62 is also formed from 12 gauge steel, which is sufficiently heavy to withstand an attempt to puncture it with a sharp pointed instrument. Another desirable feature of the module construction is that when a door 62 is locked, the door completely conceals the spanner-type threaded fasteners 50 which are employed to mount each of the boxes or compartments 38 on the module frame 16. Thus, access to these mounting screws 50 is also barred, minimizing the possibility of unauthorized personnel attempting to remove the screws.

Figure 3:
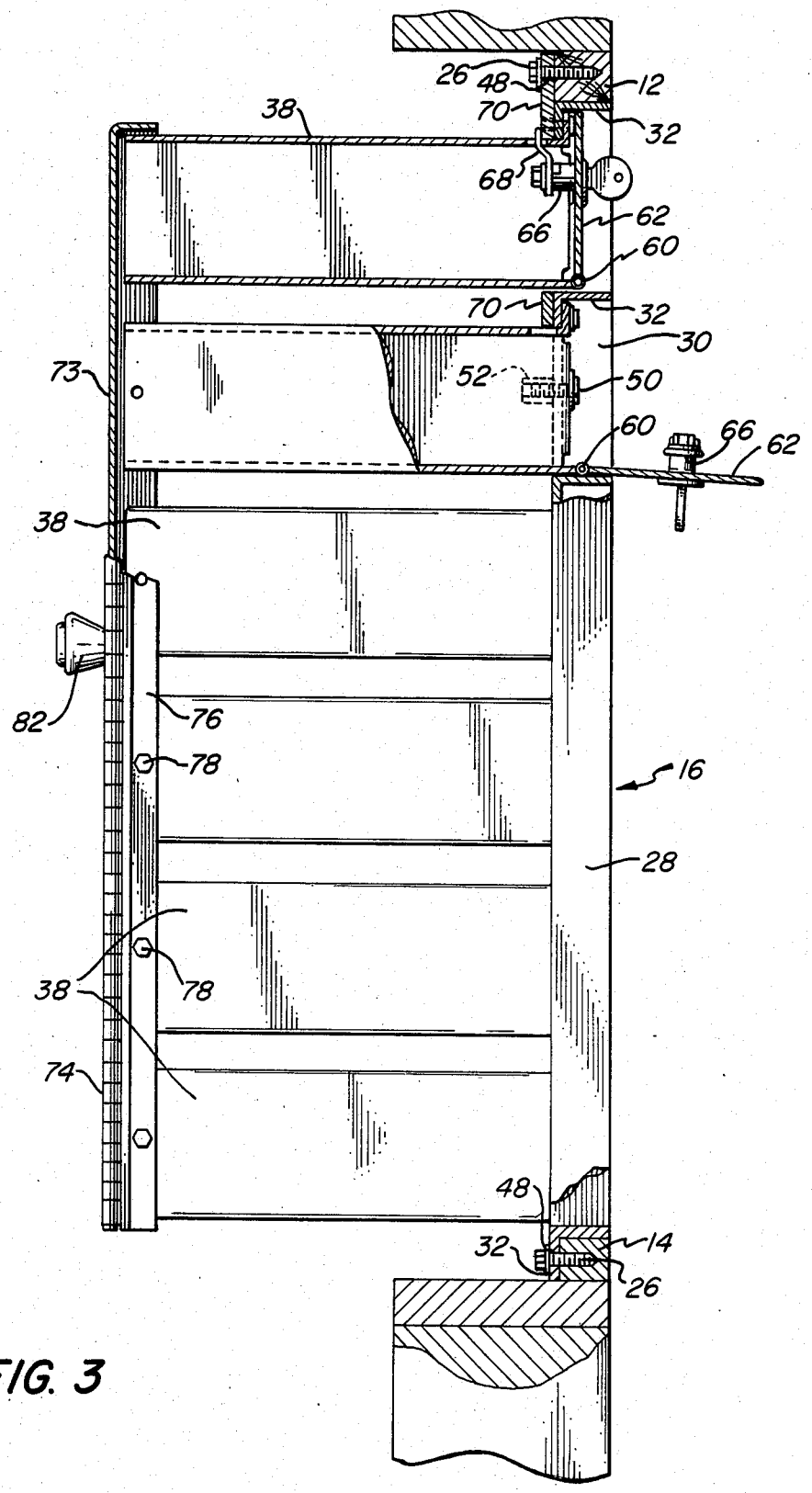
FIG. 3 is a sideview in elevation of the module and mailbox assembly of FIG. 1 a seen from the left hand side of FIG. 1, with portions partially in section to illustrate the details of the interior of each mailbox and the manner of securing each module and mailbox array on a suitable supporting framework.

As indicated in FIGS. 3 and 11, each of the modules 16 is connected by threaded fasteners 26 received through an opening 48 in the downwardly extending leg of the lowermost cross piece 32, and an extension of latch plate 70 to the bottom horizontal support 14 and top horizontal support 12 of the mailbox assembly 10.

Access to each of the modules 16 and individual compartments or boxes 38 can be had from the rear of each box 38 through a door 73 connected by a hinge 74 to an upright angle iron member 76 extending about one of the side edges of the rear of each compartment or box 38. Angle iron member 76 is secured to side wall panels of boxes 38 at spaced locations by threaded fasteners 78.

Each door 73 associated with each one of the modules 16 includes a cross piece 77 which extends between a pair of spaced, but vertically stacked ones of the boxes or compartments 38 and which is connected to upright support angle iron 76. The cross piece 77 is provided with a rearwardly projecting pin 80 received within a push button operated locking cap 82 which when depressed can be removed from pin 80 permitting the door 73 to be swung about hinge 74 to expose the rear of each of the compartments 38. The locking cap 82 and pin 80 are stock items manufactured by Southco, Inc. of Concordville, Pa.

Figure 4:
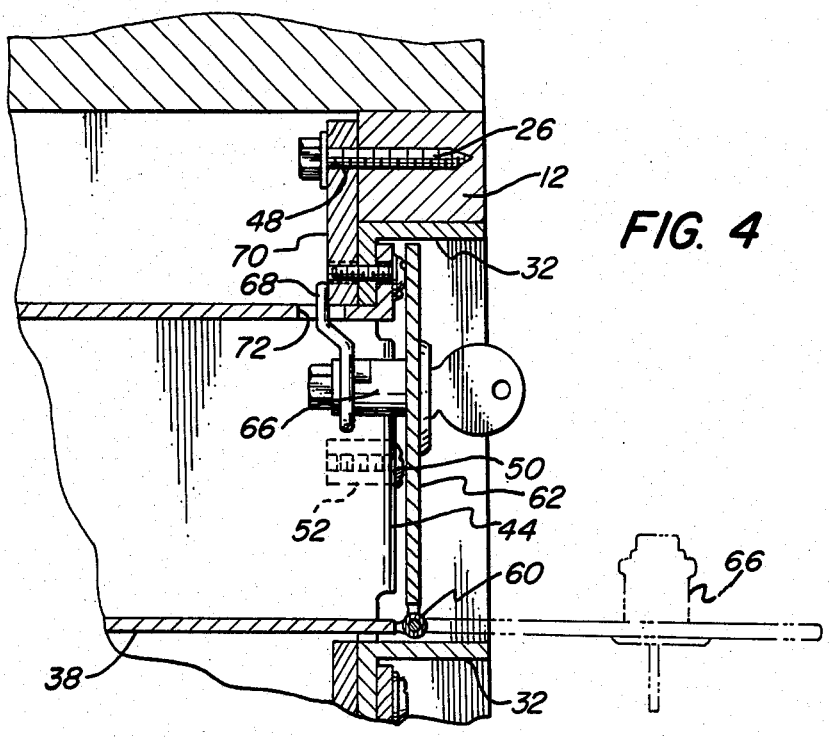
FIG. 4 is an enlarged cross-sectional view of the upper portion of the mounted mailbox module illustrated in FIG. 3, and further illustrating in phantom lines the manner in which the door to an individual mailbox supported in the module frame can be opened.
Figure 5:
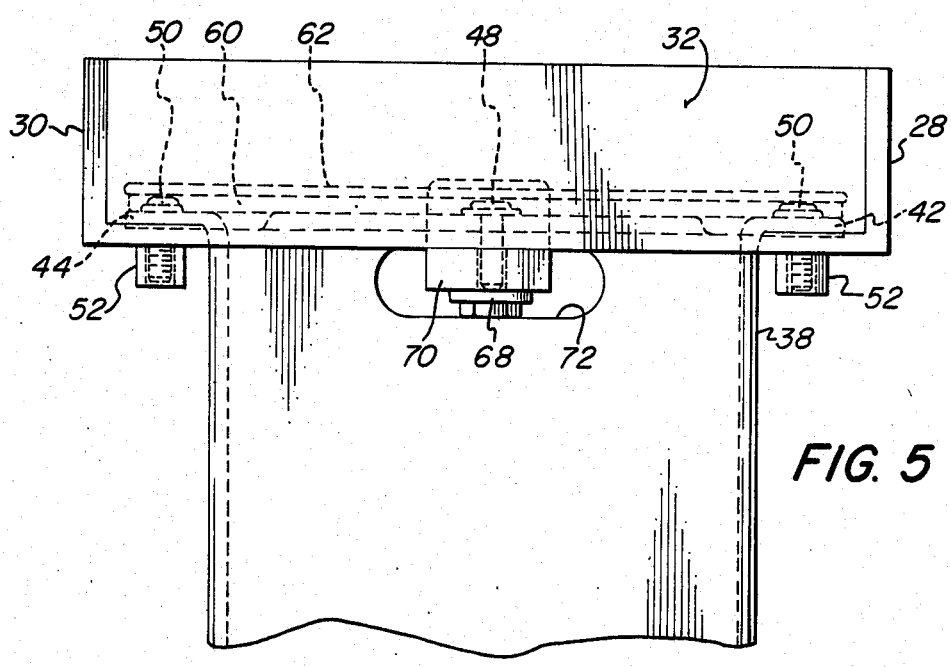
FIG. 5 is a top plan view of the module frame of FIG. 1 with one of the individual mailboxes attached thereto.

With reference to FIG. 4, it will be appreciated that the locking mechanism 66 provided on the door 62, when the door 62 is fully open, may extend into the path of movement of any parcel housed within its associated compartment or box 38. In order to avoid this, a door such as door 84 can be provided which is illustrated in FIGS. 8 and 8A. The door 84 includes an identical locking mechanism 66 as that already discussed in conjunction with the door 62, but in lieu of the hinge 60, a double hinge plate 86, 88 is provided. The hinge portion 88 is welded or otherwise secured to the top of each cross piece 32, except the top most one, so that when the door 84 is pivoted about hinge 87, it will drop down completely away from the opening into the interior of each compartment 38 as illustrated in phantom lines in FIG. 8A to enable a parcel to be removed without any impediment in its path.

Alternatively, as shown in FIGS. 9 and 9A a double hinge can be provided which is welded to the side wall along the leg of the one of upright members 28, 30 so that a door 90 will be swung laterally as indicated in FIG. 9A out of the path of the opening into box 38. Alternatively, the weld can be to the flange 42 or 44. A single plate type hinge may be connected directly to the flange 42 as illustrated in FIG. 10 so that a door 98 can be opened about the hinges as indicated in phantom lines in FIG. 10 to swing out of the way of the opening into the interior of the box 38 so as not to impede the removal of a parcel or any other material from the interior of the box 38.

What is claimed is:

1. A tamperproof mailbox assembly consisting of a horizontal and vertical array of individual mailboxes comprising:

a series of side-to-side abutted module frames for receiving a plurality of said mailboxes in a vertically stacked configuration, each frame including;

a pair of upright, parallel angle iron members and a plurality of horizontal cross pieces connecting said upright angle iron members at spaced locations along the length thereof, each of said cross pieces of said module frames being formed from an angle iron member notched at opposed ends thereof to receive one of the legs of said upright angle iron members, one of the legs of each of said upright angle iron members being spaced rearwardly from the front edge of the other leg of each of said upright angle iron members and providing a recessed support frame along with a downwardly extending leg of one of said cross pieces for receiving and supporting one of said mailboxes, and each of said mailboxes having a first opening in the front surface thereof and a second opening opposite thereto allowing mail to be placed in or retrieved from each mailbox at opposite ends and including outwardly extending flange members about said first opening adapted to be secured to said recessed legs of each of said upright angle iron frame members and a downwardly extending leg of one of said cross pieces, each of said mailboxes further including a first door pivotably connected to a panel thereof for selectively covering said first opening.

2. The mailbox assembly of claim 1 wherein each of said flange members of said mailboxes are connected to said angle iron frame members by spanner-type threaded fasteners.

3. The mailbox assembly of claim 1 including a second door hinged along one side edge thereof to each of the mailboxes in said vertically stacked configuration to close and open at each of said mailbox second openings.

4. The mailbox assembly of claim 3 including means between said second door and module frames for latching said door hinged to the side edges of said vertically stacked configuration of mail boxes.

5. The mailbox assembly of claim 1 wherein said panel comprises a bottom panel

6. The mailbox assembly of claim 5 wherein said first door is pivotable more than 90° relative to said first opening.

7. The mailbox assembly of claim 1 wherein said panel comprises a side panel.

8. The mailbox assembly of claim 7 wherein said first door is pivotable more than 90° relative to said first opening.

9. A module frame for forming a vertically stacked array of individual mailboxes for use with one or more similar modules to form a horizontal and vertical array of said mailboxes, each frame including, a series of side-to-side abutted module frames for receiving a plurality of said mailboxes in a vertically stacked configuration, each frame including:

a pair of upright, parallel angle iron members and a plurality of horizontal cross pieces connecting said upright angle iron members at spaced locations along the length thereof, each of said cross pieces of said module frames being formed from an angle iron member notched at opposed ends thereof to receive one of the legs of said upright angle iron members, one of the legs of each of said upright angle iron members being spaced rearwardly from the front edge of the other leg of each of said upright angle iron members and providing a recessed support frame along with a downwardly extending leg of one of said cross peices for receiving and supporting one of said mailboxes, and each of said mailboxes having a first opening in the front surface thereof, a second opening opposite thereto allowing mail to be placed in or retrieved from each mailbox at opposite ends and including outwardly extending flange members about said first opening adapted to be secured to said recessed legs of each of said upright angle iron frame members and a downwardly extending leg of one of said cross pieces, each of said mailboxes further including a first door pivotably connected to a panel thereof for selectively covering said first opening.

* * * * *